US006903641B2

(12) United States Patent
Kondo et al.

(10) Patent No.: US 6,903,641 B2
(45) Date of Patent: Jun. 7, 2005

(54) DUST CORE AND METHOD FOR PRODUCING THE SAME

(75) Inventors: Mikio Kondo, Aichi (JP); Shin Tajima, Aichi (JP); Takeshi Hattori, Aichi (JP); Yoji Awano, Aichi (JP); Hiroshi Okajima, Aichi-ken (JP)

(73) Assignees: Kabushiki Kaisha Toyota Chuo Kenkyusho, Aichi-gun (JP); Toyota Jidosha Kabushiki Kaisha, Toyota (JP)

( * ) Notice: Subject to any disclaimer, the term of this patent is extended or adjusted under 35 U.S.C. 154(b) by 15 days.

(21) Appl. No.: 10/466,101

(22) PCT Filed: Jan. 17, 2002

(86) PCT No.: PCT/JP02/00296

§ 371 (c)(1),
(2), (4) Date: Jul. 18, 2003

(87) PCT Pub. No.: WO02/058085

PCT Pub. Date: Jul. 25, 2002

(65) Prior Publication Data

US 2004/0061582 A1 Apr. 1, 2004

(30) Foreign Application Priority Data

Jan. 19, 2001 (JP) ..... 2001-012157

(51) Int. Cl.[7] ..... H01F 27/02

(52) U.S. Cl. ..... 336/83; 336/233; 336/90; 336/92; 336/200; 29/602.1; 29/605; 29/606

(58) Field of Search ..... 336/83, 200, 90, 336/92, 233, 177, 96; 29/602.1, 606, 605, 729

(56) References Cited

U.S. PATENT DOCUMENTS 6,759,935 B2 * 7/2004 Moro et al. ..... 336/83
6,784,782 B2 * 8/2004 Inoue et al. ..... 336/233

FOREIGN PATENT DOCUMENTS

| | | |
|---|---|---|
| JP | 61-152004 | 7/1986 |
| JP | 61-225805 | 10/1986 |
| JP | 6-260319 | 9/1994 |
| JP | 7-245209 | 9/1995 |
| JP | 8-51010 | 2/1996 |
| JP | 2000-199002 | 7/2000 |
| JP | 2001-223107 | 8/2001 |
| WO | 97/30810 | 8/1997 |
| WO | 99/30901 | 6/1999 |

* cited by examiner

*Primary Examiner*—Elvin Enad
*Assistant Examiner*—Jennifer A. Poker
(74) *Attorney, Agent, or Firm*—Oblon, Spivak, McClelland, Maier & Neustadt, P.C.

(57) ABSTRACT

The present invention is characterized in that, in a powder magnetic core obtained by compaction of an iron-based magnetic powder covered with an insulation film, a saturation magnetization Ms is Ms≧1.9 T in a 1.6 MA/m magnetic field; a specific resistance ρ is ρ≧1.5 μΩm; a magnetic flux density $B_{2k}$ is $B_{2k}$≧1.1 T in a 2 kA/m magnetic field; and a magnetic flux density $B_{10k}$ is $B_{10k}$≧1.6 T in a 10 kA/m magnetic field. In accordance with the present invention, it has been possible to industrially carry out compacting iron-based magnetic powders under remarkably high compacting pressures. As a result, high-performance powder magnetic cores are obtained which have a high density, and which are good in terms of the specific resistance and magnetic permeability.

26 Claims, 4 Drawing Sheets

DUST CORE AND METHOD FOR PRODUCING THE SAME

TECHNICAL FIELD

The present invention relates to a powder magnetic core which is good in terms of the electric characteristics, such as the specific resistance, as well as the magnetic characteristics, such as the magnetic permeability, and processes for producing them.

BACKGROUND ART

Around us, there are many articles, such as transformers (transformers), electric motors (motors), generators, speakers, induction heaters and a variety of actuators, which utilize electromagnetism. In order to make them high-performance and downsize them, it is indispensable to improve the performance of permanent magnets (hard magnetic substances) and soft magnetic materials. Hereinafter, among these magnetic materials, magnetic cores (magnetic cores), one of soft magnetic materials, will be hereinafter described.

When magnetic cores are disposed in magnetic fields, it is possible to produce large magnetic flux densities, and accordingly it is possible to downsize electromagnetic appliances and improve the performance. Naming a specific example, magnetic cores are used in order to enlarge local magnetic flux densities by fitting them into electromagnetic coils (hereinafter, simply referred to as coils), or to form magnetic circuits by intervening them in a plurality of coils.

Such magnetic cores are required to exhibit a large magnetic flux in order to enlarge magnetic flux densities, and simultaneously to exhibit a less high-frequency loss (iron loss) because they are often used in alternating magnetic fields. As the high-frequency loss, there are hysteresis loss, eddy current loss and residual loss, however, the hysteresis loss and the eddy current loss matter mostly. The hysteresis loss is proportional to the frequency of alternating magnetic fields, on the other hand, the eddy current loss is proportional to the square of the frequency. Accordingly, when they are used in high-frequency ranges, it is especially required to reduce the eddy current loss. In order to reduce the eddy current loss, it is needed to reduce currents which flow into magnetic cores by induction electromotive forces, to put it differently, it is desired to enlarge the specific resistance of magnetic cores.

Conventional magnetic cores have been manufactured by laminated silicon steel while intervening insulative layers therebetween. In this case, it is difficult to manufacture small magnetic cores, moreover, the eddy current loss is still large because the specific resistance is small. Hence, as magnetic cores whose formability is improved, magnetic cores are used in which iron-based powders are sintered. However, since the magnetic cores exhibit a small specific resistance, they are mainly used in DC coils, and are less likely to be used in AC coils. Moreover, in order to enlarge the specific resistance, it is disclosed in PCT International Laid-Open Publication No. 2000-504,785 and the like to manufacture a magnetic core by high-pressure forming an iron-based magnetic powder covered with an insulation film. When this iron-based magnetic powder is used, since it is good in terms of the formability, and simultaneously since the respective particles of the powder are covered with the insulation film, a magnetic core with a large specific resistance is obtained. Hereinafter, magnetic cores which are made by pressure forming iron-based magnetic powders thus covered with insulation films will be referred to as "powder magnetic cores."

Thus, the powder magnetic cores exhibit a large specific resistance, and exhibit a large degree of configuration freedom, however, the conventional powder magnetic cores have a low density and the magnetic characteristics, such as the magnetic permeability, are not necessarily sufficient. Of course, it is possible to highly densify the powder magnetic cores by enlarging the compacting pressure, however, it has been difficult inherently to enlarge the compacting pressure. Because, when the compacting pressure is enlarged to high pressures, galling occurs on the surface of dies so that dies are impaired and the surface of powder magnetic dies is bruised, and moreover ejecting forces are enlarged so that it has become difficult to eject powder magnetic cores. Such assignments are detrimental when considering industrial mass-production.

Note that, in view of known literatures, there might exist descriptions and the like to the effect that high-pressure forming is possible, however, highly densifying powder magnetic cores, improving the magnetic characteristics and the like have not been accomplished actually so far by that means.

DISCLOSURE OF INVENTION

The present invention has been done in view of such circumstances, and it is therefore an object to provide a powder magnetic core which is good in terms of the magnetic characteristics which have not been available conventionally, while securing a high specific resistance. Moreover, it is an object to provide a process for producing a powder magnetic core, process which is suitable to the production of such a powder magnetic core.

And, the present inventors have been studying earnestly in order to solve this assignment, have been repeated trials and errors, and, as a result, have succeeded in forming iron-base magnetic powders covered with insulation films under high pressures which have not been available conventionally, and have arrived at completing the present invention.

Powder Magnetic Core

Namely, a powder magnetic core of the present invention is characterized in that, in a powder magnetic core obtained by pressure forming an iron-based magnetic powder covered with an insulation film, a saturation magnetization Ms is $Ms \geqq 1.9$ T in a 1.6 MA/m magnetic field;

a specific resistance $\rho$ is $\rho \geqq 1.5\ \mu\Omega m$;

a magnetic flux density $B_{2k}$ is $B_{2k} \geqq 1.1$ T in a 2 kA/m magnetic field; and a magnetic flux density $B_{10k}$ is $B_{10k} \geqq 1.6$ T in a 10 kA/m magnetic field.

In accordance with the present invention, by pressure forming a ferromagnetic iron-based magnetic powder covered with an insulation film, a powder magnetic core can be obtained while it is provided with a sufficient specific resistance, powder magnetic core which is good in terms of the magnetic characteristics, such as the magnetic flux density, which have not been available conventionally.

Specifically, since the surface of an iron-based magnetic powder is covered with an insulation film, it is possible to secure such a large specific resistance $\rho$ as 1.5 $\mu\Omega m$ or more. Thus, it is possible to reduce the eddy current loss.

Moreover, a powder magnetic core can be obtained which shows such large flux densities that a magnetic flux density $B_{2k}$ is 1.1 T or more in such a low magnetic filed as 2 kA/m magnetic field and a magnetic flux density $B_{10k}$ is 1.6 T or more in such a high magnetic field as 10 kA/m. Namely, a powder magnetic core with a high magnetic permeability in a broad range can be obtained. In addition, since the saturation magnetization Ms is as large as 1.9 T (in a 1.6 MA/m magnetic field), large flux densities can be produced stably in high magnetic fields as well.

Thus, in accordance with the present powder magnetic core, since it simultaneously has a sufficiently large specific resistance and high flux densities and the like in magnetic fields over a wide range, it is possible to make electromagnetic appliances high-output and high-performance or to make them small and lightweight while reducing the eddy current loss.

By the way, the smaller the green compact of an iron-based magnetic powder is, the more likely a powder magnetic core with a high magnetic flux density is obtained, and accordingly it is suitable that the density d of the powder magnetic core can be $7.4\times10^3$ kg/m$^3$ or more.

Moreover, when the present powder magnetic core exhibits such a high strength that a 4-point bending strength $\sigma$ is 50 MPa or more, it is convenient because the usage can be expanded to a variety of products in a diversity of fields.

Production Process of Powder Magnetic Core

A powder magnetic core which exhibits such a large specific resistance and is good in terms of the magnetic characteristics can be obtained by using the following production process according to the present invention, for example.

Namely, a process for producing a powder magnetic core is characterized in that it comprises: a coating step of coating an insulation film on a surface of an iron-based magnetic powder; an applying step of applying a higher fatty acid-based lubricant to an inner surface of a die; a filling step of filling the iron-based powder with the insulation film coated into the die with the higher fatty acid-based lubricant applied; and a forming step of warm compaction of the iron-based magnetic powder filled in the die.

When an iron-based powder with an insulation film coated is filled into a forming die with a higher fatty acid-based lubricant applied and is formed by warm compaction, the lubricating property between the inner wall of the forming mold and the iron-based powder (green compact) is improved though the reason has not been definite yet. As a result, it is possible to reduce the ejecting force when ejecting the green compact from the die. Moreover, it is possible to suppress or inhibit the fixation or galling between the inner wall of the die and the green compact.

Thus, it has been possible to produce high-density powder magnetic cores by high-pressure compacting. And, it has been possible to obtain powder magnetic cores whose specific resistance is large and which is simultaneously good in terms of the magnetic characteristics, such as the magnetic flux density, with ease.

Note that, in the case of the present invention, it is not necessary to further mix and the like a lubricant (an admixed lubricant) with an iron-based magnetic powder with an insulation film coated. Namely, it is not needed to carry out internal lubrication. When the present production process is used, since it is possible to carry out forming by high pressures which have not been available conventionally while avoiding the damages of the die, the increment of the ejecting force and so forth, a sufficient formability is obtained for iron-based magnetic powders without carrying out internal lubrication.

Since internal lubrication is not carried out so that no unnecessary intervening substances are present inside power magnetic cores (between iron-based magnetic powders), it is rather possible to further highly densify powder magnetic cores, and to improve the magnetic characteristics and strength thereof.

BEST MODE FOR CARRYING OUT THE INVENTION

A. Mode for Carrying Out

Figure 1:
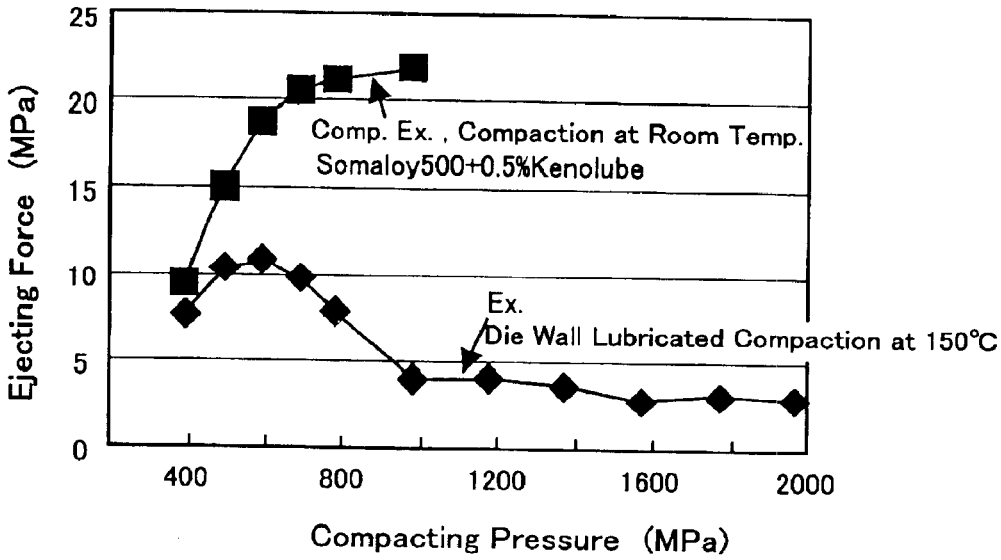
FIG. 1 is a graph for illustrating the relationships between compacting pressures and ejecting forces.

Hereinafter, while naming embodiment modes, the present invention will be described more specifically.

Powder Magnetic Core (1) Specific Resistance

The specific resistance does not depend on shapes, and is an intrinsic value for every powder magnetic core, when powder magnetic cores are formed as an identical shape, the larger the specific resistance is, the more the eddy current loss can be reduced. And, when the specific resistance $\rho$ is less than 1.5 $\mu\Omega$m, since it is not possible to sufficiently reduce the eddy current loss, the specific resistance $\rho$ can preferably be 1.5 $\mu\Omega$m or more, further 7 $\mu\Omega$m or more, and can furthermore preferably be 10 $\mu\Omega$m or more.

(2) Magnetic Flux Density

The magnetic flux density can be determined by Magnetic Permeability $\mu$=(Magnetic Flux Density B)/(Strength H of Magnetic Field), however, it is understood from general B-H curves that $\mu$ is not constant. Hence, the magnetic characteristics of the present powder magnetic core are not assessed directly by the magnetic permeability, but are assessed by a magnetic flux density which is produced when it is placed in a magnetic field of specific strength. Namely, as an example, a low magnetic field (2 kA/m) and a high magnetic field (10 kA/m) are selected, and the magnetic characteristics of powder magnetic cores are assessed by the magnetic flux densities $B_{2k}$ and $B_{10k}$ which are produced when powder magnetic cores are placed in those magnetic fields.

And, in accordance with the present powder magnetic core, it is possible to produce a sufficiently large magnetic flux density, $B_{2k}\geqq1.1$ T, even in the low magnetic field of 2 kA/m, and it is further possible to produce a magnetic flux density, $B_{2k}\geqq1.3$ T.

Moreover, it is possible to produce a sufficiently large magnetic flux density, $B_{10k}\geqq1.6$ T, even in the high magnetic field of 10 kA/m, and it is further possible to produce a magnetic flux density, $B_{10k}\geqq1.7$ T.

Note that large flux densities cannot be produced in high magnetic fields when the saturation magnetization Ms is small, however, in accordance with the present powder magnetic core, for example, since the saturation magnetization Ms is Ms$\geqq$1.9 T, further 1.95 T or more, in a 1.6 MA/m magnetic field, it is possible to stably produce large magnetic flux densities even in high magnetic fields beyond 10 kA/m.

(3) Strength

The powder magnetic core comprises, contrary to magnetic cores cast or sintered at high temperatures, a green compact of the iron-based magnetic powder in which the surface of the respective particles is covered with the insulation film. Therefore, the bond between the respective particles is mechanical bond accompanied by plastic deformation, and is not chemical bond. Accordingly, in the case of conventional powder magnetic cores whose compacting pressure is low, they are insufficient in view of the strength, and their application range is limited.

However, in the present powder magnetic core, since the compacting pressure is a high pressure, the bond between the respective particles of the iron-based magnetic powder becomes firm, and accordingly it is possible to produce such a high strength that the 4-point bending strength $\sigma$ is 50 MPa or more, further 100 MPa or more, for example. Note that the 4-point bending strength $\sigma$ is not prescribed in JIS, but can be determined by the testing methods of green compacts.

The 4-point bending strength indexes the bending strength mainly, but, not limited to the bending strength, the present powder magnetic core is also good in terms of the tensile and compression strengths, and the like. Note that, not limited to the 4-point bending strength, the strength of the present powder core can be indexed by radial crushing strength, and so forth.

(4) Iron-based Magnetic Powder

In order to produce a high magnetic flux density while reducing the hysteresis loss by reducing the coercive force, it is suitable that said iron-based magnetic powder can be an iron powder composed of pure iron. And, it is suitable that the purity can be 99.5% or more, further 99.8% or more.

As for such an iron powder, it is possible to use ABC100.30 produced by Höganäs AB. This iron powder is an iron powder whose components other than Fe are C: 0.001, Mn: 0.02 and C: 0.08 (unit: % by mass) or less, whose impurities are remarkably less compared with the other commercially available iron powders, and which is good in terms of the compressibility.

Moreover, when the present inventors carried out additional tests and the like, the following were newly apparent. Namely, the iron-based magnetic powder can be iron alloy powders which contain, other than pure iron, ferromagnetic materials (elements) such as cobalt (Co), nickel (Ni), and so forth. In this case, when the entire powder magnetic core is taken as 100% by mass, if Co can be 50% by mass or less, or 30% by mass or less, and furthermore 5% mass or more (for instance, from 5 to 30% by mass), for example, it is good in terms of the high magnetic flux density.

In addition, it has been apparent that the iron-based magnetic powder can be iron alloy powders which contain silicon (Si). In this case, if Si can be 7% by mass or less, or 4% by mass or less, and furthermore 0.3% by mass or more (for instance, from 0.3 to 4% by mass), for example, it is good in terms of the high magnetic flux density and low coercive force. Indeed, when Si exceeds 7% by mass, the iron-based magnetic powder becomes so hard that it is difficult to improve the density of the powder magnetic core. Note that Al also exhibits effects similarly to Si.

And, even in either case, the less the impurity elements lowering the magnetic characteristics are, the better it is. Moreover, the iron-based magnetic powder can be mixture powders in which a plurality of powders appropriate for magnetic-core materials are mixed. For example, it is possible to utilize mixture powders such as a pure iron powder and an Fe-49Co-2V (Permendur) powder and a pure iron powder and an Fe-3Si powder. Moreover, in the present invention, since it is possible to carry out high pressure forming at 1,000 MPa or more, it has been possible to utilize mixture powders of the high-hardness Sendust (Fe-9Si-6Al) powder, which has been difficult to form conventionally, and a pure iron powder. In particular, when commercially available iron-based magnetic powders are used, it is preferable because it is possible to reduce the cost of powder magnetic cores.

Next, the iron-based magnetic powder can be composed of granulated powders, or elemental grain powders. Moreover, in order to efficiently obtain high-density powder magnetic cores, it is suitable that the particle diameters can fall in a range of from 20 to 300 $\mu$m, further from 50 to 200 $\mu$m.

When the present inventors further carried out additional tests and the like, in order to especially reduce the eddy current loss, it was newly apparent that it is further preferred that the particle diameters of the iron-based magnetic powder can be finer. Specifically, it is preferred that the particle diameters can be 105 $\mu$m or less, further 53 $\mu$m or less. On the other hand, in order to reduce the hysteresis loss, it is preferred that the particle diameters can be coarser. Hence, it is further preferred that the particle diameters can be 53 $\mu$m or more, further 105 $\mu$m or more, for example. Note that the classification of the iron-based magnetic powder can be carried out by a sieve classification method and so forth with ease.

(5) Insulation Film

The insulation film is coated on a surface of the respective particles of the iron-base magnetic powder. Due to the presence of this insulation film, it is possible to obtain the powder magnetic core exhibiting a larger specific resistance.

The following characteristics are required for the insulation film: ① to exhibit a high electric resistance; ② to have a high adhesion force to magnetic powders so as not to be come off by the contact and the like between powders during forming; ③ to have a high sliding property and a low friction coefficient so that the slippage between powders and the plastic deformation are likely to occur when powders contact with each other during forming; and ④ to be a ferromagnetic material, if possible.

However, at present, no insulation film satisfying aforementioned ④ has been discovered, insulation film which is applicable to materials for powder magnetic cores. Hence, as for the insulation film which satisfies aforementioned ① through ③ at high levels, the present inventors decided to use phosphate-based insulation films or $SiO_2$, $Al_2O_3$, $TiO_2$, $ZrO_2$ and composite oxide-based insulation films composed of these. Note that these films can be those which are obtained by coating them per se, or those which are obtained by reacting the components (for example, Fe, Si, and the like) in the iron-based magnetic powder with a phosphoric acid and so forth.

Since phosphate-based insulation films are good in terms of aforementioned ② and ③ and are less likely to come off even during high-pressure compaction, they are likely to make the high magnetic flux density and high magnetic permeability, which are induced by the high electric resistance and high densification, compatible.

On the other hand, since oxide-based insulation films exhibit high heat resistance, there is an advantage in that later-described post-compacting strain-removing annealing (anneal) is likely to be carried out. Therefore, whether phosphate-based insulation films are used, or whether oxide-based insulation films are used can be selected in accordance with the intended applications of the powder magnetic core.

By the way, when iron-based magnetic powders are formed by warm compaction as in the present production process, a novel lubricant (a lubricant film of metallic soap), which is very full of lubricating property, is formed between an inner wall of compacting dies and iron-based magnetic powders. When this lubricant includes Fe (for example, when it is an iron-salt film of higher fatty acids), it exhibits the best lubricating property. Therefore, in view of facilitating the formation of such iron-salt films, when the insulation film per se rather has compositions including Fe, it is further effective to improve the lubricating property between an inner wall of compacting dies and iron-based magnetic powders. Hence, the insulation film can desirably be, for example, iron phosphates when it is phosphate-based ones, and composite oxide-based ones, which are composited with Fe, such as $FeSiO_3$, $FeAl_2O_4$ and $NiFe_2O_4$, when it is oxide-based ones.

And, from such a viewpoint, it is suitable that the present magnetic core powder can be newly adapted to be obtained by: a coating step in which an insulation film containing Fe is coated on a surface of an iron-based magnetic powder; an applying step of applying a higher fatty acid-based lubricant to an inner surface of a compacting die; a filling step of filling the iron-based magnetic powder with the insulation film coated into the forming mold with the higher fatty acid-based lubricant applied; and a forming step of warm pressure compaction the iron-based magnetic powder filled in the compacting die so that a metallic soap film is formed by a reaction between Fe in the insulation film and the higher fatty acid-based lubricant, wherein: a saturation magnetization Ms is $Ms \geqq 1.9$ T in a 1.6 MA/m magnetic field; a specific resistance $\rho$ is $\rho \geqq 1.5\ \mu\Omega m$; a magnetic flux density $B_{2k}$ is $B_{2k} \geqq 1.1$ T in a 2 kA/m magnetic field; and a magnetic flux density $B_{10k}$ is $B_{10k} \geqq 1.6$ T in a 10 kA/m magnetic field.

Moreover, it is suitable that the production process of the same can be adapted to comprise: a coating step in which an insulation film containing Fe is coated on a surface of an iron-based magnetic powder; an applying step of applying a higher fatty acid-based lubricant to an inner surface of a compacting die; a filling step of filling the iron-based magnetic powder with the insulation film coated into the compacting die with the higher fatty acid-based lubricant applied; and a forming step of warm compaction of the iron-based magnetic powder filled in the compacting die so that a metallic soap film is formed by a reaction between Fe in the insulation film and the higher fatty acid-based lubricant.

Production Process of Powder Magnetic Core (1) Coating Step

The coating step is a step in which an insulation film is coated on a surface of an iron-based magnetic powder. As described above, there are a variety of insulation films, however, in view of the adhering property, sliding property and electric resistance, phosphate films are especially preferable. Hence, it is suitable that the coating step can be a step in which a phosphoric acid is contacted with an iron-based magnetic powder to form a phosphate film (especially, an iron phosphate film) on a surface of the iron-based magnetic powder.

As for how to contact a phosphoric acid with an iron-based magnetic powder, for example, there are a way in which phosphoric acid solutions made by mixing phosphoric acids in water or organic solvents are sprayed to iron-based magnetic powders, a way in which iron-based magnetic powders are immersed into the phosphoric acid solutions, and the like. Note that, as for organic solvents set forth herein, there are ethanol, methanol, isopropyl alcohol, acetone, glycerol, and so forth. Moreover, it is good to control the concentration of the phosphoric acid solutions in a range of from 0.01 to 10% by mass, further from 0.1 to 2% by mass.

(3) Applying Step

The applying step is a step in which a higher fatty acid-based lubricant is applied to an inner surface of a compacting die.

① It is suitable that the higher fatty acid-based lubricant can be metallic salts of higher fatty acids in addition to higher fatty acids per se. As for the metallic salts of higher fatty acids, there are lithium salts, calcium salts or zinc salts, and the like. In particular, lithium stearate, calcium stearate and zinc stearate are preferable. In addition, it is also possible to use barium stearate, lithium palmitate, lithium oleate, calcium palmitate, calcium oleate, and so forth.

② It is suitable that the applying step can be a step in which the higher fatty acid-based lubricant, which is dispersed in water or an aqueous solution, is sprayed into the compacting die, which is heated.

When the higher fatty acid-based lubricant is dispersed in water, or the like, it is easy to uniformly spray the higher fatty acid-based lubricant onto the inner surface of the compacting die. Moreover, when it is sprayed into the heated die, the water content evaporates quickly so that it is possible to uniformly adhere the higher fatty acid-based lubricant on the inner surface of the die.

Note that, although it is necessary to take the temperature in the later-described forming step into consideration, it is sufficient to heat the die to 100° C. or more, for example. In actuality, however, in order to form a uniform higher fatty acid-based lubricant film, it is preferable to control the heating temperature to less than the melting point of the higher fatty acid-based lubricant. For instance, when lithium stearate is used as the higher fatty acid-based lubricant, it is good to control the heating temperature to less than 200° C.

Note that, when the higher fatty acid-based lubricant is dispersed in water, or the like, it is preferred that, if the higher fatty acid-based lubricant is included in a proportion of from 0.1 to 5% by mass, further from 0.5 to 2% by mass, when the entire mass of the aqueous solution is taken as 100% by mass, a uniform lubricant film can be formed on the inner surface of the die.

Moreover, in dispersing the higher fatty acid-based lubricant in water, or the like, when a surfactant is added to the water, it is possible to uniformly disperse the higher fatty acid-based lubricant. As such a surfactant, it is possible to use alkylphenol-based surfactants, 6-grade polyoxyethylene nonyl phenyl ether (EO), 10-grade polyoxyethylene nonyl phenol ether (EO), anionic and amphoteric surfactants, boric acid ester-based emulbon "T-80," and the like, for example. It is good to combine two or more of the surfactants to use. For instance, when lithium stearate is used as the higher fatty acid-based lubricant, it is preferable to use three kinds of surfactants, 6-grade polyoxyethylene nonyl phenyl ether (EO), 10-grade polyoxyethylene nonyl phenyl ether (EO) and boric acid ester emulbon "T-80," at the same time. This is because, when the surfactants are composited and added, the dispersibility of lithium stearate to water, or the like, is furthermore activated, compared with the case where only of them is added.

Moreover, in order to obtain the higher fatty acid-based lubricant aqueous solution which exhibits a viscosity applicable to spraying, it is preferable to control the proportion of the surfactant in a range of from 1.5 to 15% by volume when the entire aqueous solution is taken as 100% by volume.

In addition to this, it is good to add a small amount of an antifoaming agent (for example, silicone-based antifoaming agents, and the like). This is because, if the aqueous solution bubbles vigorously, it is less likely to form a uniform higher fatty acid-based lubricant film on the inner surface of the die when it is sprayed. The addition proportion of the antifoaming agent can preferably be from 0.1 to 1% by volume approximately, for instance, when the entire volume of the aqueous solution is taken as 100% by volume.

③ It is suitable that the particles of the fatty acid-based lubricant, which is dispersed in water, or the like, can preferably have a maximum particle diameter of less than 30 μm.

When the maximum particle diameter is 30 μm or more, the particles of the higher fatty acid-based lubricant are likely to precipitate in the aqueous solution so that it is difficult to uniformly apply the higher fatty acid-based lubricant on the inner surface of the forming mold.

④ When the aqueous solution, in which the higher fatty acid-based lubricant is dispersed, is applied, it is possible to carry it out by using spraying guns for coating operations, electrostatic guns, and the like.

Note that, when the inventors of the present invention examined the relationship between the applying amounts of the higher fatty acid-based lubricant and the ejecting forces for green compacts by experiments, as a result, it was understood that it is preferable to deposit the higher fatty acid-based lubricant in such a thickness of from 0.5 to 1.5 μm approximately on the inner surface of the die.

(3) Filling Step

The filling step is a step in which the iron-based magnetic powder with the insulation film coated is filled into the compacting die with the higher fatty acid-based lubricant applied.

It is suitable that this filling step can be a step in which the iron-based magnetic powder heated is filled into the forming mold heated. When both of the iron-based magnetic powder and forming mold are heated, in the subsequent forming step, the iron-based magnetic powder is reacted stably with the higher fatty acid-based lubricant so that a uniform lubricant film is likely to be formed between them. Hence, it is preferable to heat both of them to 100° C. or more, for example.

(4) Forming Step

The forming step is a step in which the iron-based magnetic powder filled into the compacting die is formed by warm compaction.

① Although the details have not been cleared yet, it is believed that, due to this process, the higher fatty acid-based lubricant applied on the inner surface of the die and at least the iron-based magnetic powder contacting with the inner surface of the die cause so-called mechanochemical reactions.

Due to the reactions, the iron-based magnetic powder (especially, the insulation film) and the higher fatty acid-based lubricant are bonded chemically, and accordingly a metallic soap film (for example, an iron salt film of a higher fatty acid) is formed on a surface of a green compact of the iron-based magnetic powder. And, the metallic soap film is firmly bonded to the surface of the green compact, and effects far better lubricating performance than the higher fatty acid-based lubricant does which has been adhered to the inner surface of the die. As a result, it is believed that the frictional force between the inner surface of the die and the outer surface of the green compact arrives at being reduced sharply.

Note that, since the respective particles of the iron-based magnetic powder are coated with the insulation film as described above, it is preferred that the insulation film per se can contain an element (for example, Fe) which facilitates the formation of the metallic soap film. Thus, the metallic soap film can be formed on the inner surface of the die more securely.

Anyway, it is believed that pressure forming under high pressures, which has been considered difficult conventionally, has been thus made possible. And, since it has been possible to take out high-density green compacts from dies with ease without causing galling and the like resulting in damaging dies, it has been possible to produce powder magnetic cores which have a high density and are good in terms of the magnetic characteristics, such as the magnetic permeability, with industrial efficiency.

② The compacting temperature in the forming step is determined by taking the types of the iron-based magnetic powder, insulation film and higher fatty acid-based lubricant, the compacting pressure and the like into consideration. Therefore, in the forming step, the term, "warm," implies that the forming step is carried out under properly heated conditions depending on specific circumstances. In actuality, however, it is preferable in general to control the compacting temperature to 100° C. or more in order to facilitate the reaction between the iron-based magnetic powder and the higher fatty acid-based lubricant. Moreover, it is preferable in general to control the forming temperature to 200° C. or less in order to inhibit the insulation film from being destroyed and inhibit the higher fatty acid-based lubricant from being degraded. And, it is more suitable to control the compacting temperature in a range of from 120 to 180° C.

③ The extent of "pressurizing" in the forming step is determined according to the characteristics of desired powder magnetic cores, the types of the ion-based magnetic powder, insulation film and higher fatty acid-based lubricant, the material qualities and inner surface properties of the die, and the like. However, when the present production process is used, it is possible to carry out compacting under high pressures which are beyond conventional compacting pressures. Accordingly, it is possible to control the compacting pressure to 700 MPa or more, further 785 MPa or more, furthermore 1,000 MPa or more, for example, and, the higher the compacting pressure is, it is possible to obtain a powder magnetic core with a higher density.

Moreover, when the present inventors carried out additional tests, it become apparent that the production of powder magnetic cores can be carried out even in the case where the compacting pressure is increased to 2,000 MPa approximately. Indeed, taking the longevity of forming molds and the productivity into consideration, it is good to control the compacting pressure to 2,000 MPa or less, more desirably to 1,500 MPa or less.

④ Here, regarding the compacting pressure, the present inventors confirmed the following by experiments.

Namely, in the case were a higher fatty acid-based lubricant (lithium stearate) was applied on an inner surface of a die, the forming temperature was set at 150° C., and an iron-based magnetic powder was formed by pressurizing, the pressure for ejecting the powder magnetic core from the die was rather lower when the compacting pressure was set at 686 MPa than when the compacting pressure was set at 588 MPa. This was a discovery which overturns the conventional idea that the higher the compacting pressure is the higher the ejecting force is. Moreover, they confirmed that it is possible to carry out compacting even when the compacting pressure is heightened to 981 MPa, and simultaneously discovered that iron stearate adheres to a surface of the green compact.

Similarly, regarding calcium stearate and zinc stearate as well, when an iron-based magnetic powder is formed by pressurizing at an appropriate compacting temperature, it is expected that the phenomenon that the ejecting force of the green compact decreases instead would occur. Therefore, the above-described compacting pressure can preferably be such a pressure that the iron-based magnetic powder and the higher fatty acid-based lubricant bond chemically to generate the metallic soap film.

The reason for this is believed that, as described above, the metallic soap film (for example, a film of an iron salt of a higher fatty acid like an iron stearate monomolecular film) is formed on the surface of the powder compact of an iron-based magnetic powder, and the film reduces the frictional force between the inner surface of a die and the powder compact to decrease the ejecting force of the powder compact.

Moreover, as described later, when the present inventors confirmed by carrying out additional tests, in the case where the present production process is used, it was appreciated that the ejecting force reaches the maximum when the compacting pressure is about 600 MPa, and that the ejecting force lowers instead when it is more than this. And, it was also appreciated that, even when the compacting pressure is varied in a range of from 900 to 2,000 MPa, the ejecting force maintains such a very low value that it is 5 MPa approximately.

Thus, when the present production process is used, the unique phenomenon occurs which is not present in conventional production processes. It is believed that the thus occurred phenomenon results in obtaining powder magnetic cores which have a high density and are good in terms of the magnetic characteristics, and the like. Note that, not limited to the case where lithium stearate is used, the phenomenon can occur similarly even when calcium stearate and zinc stearate are used.

(5) Annealing Step

The annealing step is a step in which the green compact obtained after said forming step is heated.

By carrying out the annealing step, the residual stress or strain in the green compact is removed so that it is possible to improve the magnetic characteristics. Therefore, it is suitable to carry out the annealing step after the forming step.

It is suitable that, in the case of phosphate-based insulation films, the annealing step can include a heating step in which the heating temperature is set in a range of from 300 to 600° C. and the heating time is set in a range of from 1 to 300 minutes. Moreover, it is further preferable to set the heating temperature in a range of from 350 to 500° C. and the heating time in a range of from 5 to 60 minutes.

When the heating temperature is less than 300° C., the effect of reducing residual stress and strain is poor, and it is because the insulation film is destroyed when it exceeds 600° C. Moreover, when the heating time is less than 1 minute, the effect of reducing residual stress and strain is poor, and it is because the effect is not upgraded all the more when it is heated for beyond 300 minutes.

⑥ Based on above, it is suitable that the present process for producing a powder magnetic core can be a process for producing a powder magnetic core, comprising: a coating step of coating an insulation film on a surface of an iron-based magnetic powder; an applying step of applying a higher fatty acid-based lubricant to an inner surface of a die; a filling step of filling the iron-based magnetic powder with the insulation film coated into the die with the higher fatty acid-based lubricant applied; and a forming step of warm compaction of the iron-based magnetic powder filled in the die; whereby a powder magnetic core is obtained whose: saturation magnetization Ms is Ms≧1.9 T in a 1.6 MA/m magnetic field; specific resistance ρ is ρ≧1.5 μΩm; magnetic flux density $B_{2k}$ is $B_{2k}$≧1.1 T in a 2 kA/m magnetic field; and magnetic flux density $B_{10k}$ is $B_{10k}$≧1.6 T in a 10 kA/m magnetic field.

Applications of Powder Magnet Core

The present powder magnetic core can be used for a variety of electromagnetic equipment, such as motors, actuators, transformers, induction heaters (IH) and speakers. And, since the present powder magnetic core is such that the specific resistance as well as the magnetic permeability are large, it is possible to highly enhance the performance of the various appliances, downsize them, make them energy-efficient, and the like, while suppressing the energy loss. For example, when this powder magnetic core is incorporated into fuel injection valves of automotive engines, and so forth, since not only the powder magnetic core is good in terms of the magnetic characteristics but also its high-frequency loss is less, it is possible to realize downsizing them, making them high power and simultaneously making them high response.

In addition, when the powder magnetic core according to the present invention is used in motors such as DC machines, induction machines and synchronous machines, it is suitable because it is possible to satisfy both downsizing and making motors high power.

B. EXAMPLES

While naming examples hereinafter, the present invention will be hereinafter described in more detail.

Production Process

(1) Example

The present inventors carried out a variety of new additional test as hereinafter described, first of all, they determined to confirm the effectiveness of the production process according to the present invention first. In this instance, from the viewpoint of the ejecting forces for ejecting green compacts from dies and the density of obtained green compacts, they investigated the effectiveness mainly. This will be hereinafter described specifically.

① First, as a raw material powder (an iron-based magnetic powder) used for producing a powder magnetic core according to the present invention, a commercially available iron powder ("ABC100.30" produced by Höganäs AB.: purity 99.8% Fe) was prepared. Note that it was used herein as it was procured without particularly carrying out the classification and the like of the raw material powder. The particle diameters were from about 20 to 180 μm.

Phosphate (insulation film) coating was carried out onto this Fe powder (a coating step). This coating step was carried out by mixing a phosphoric acid in a proportion of 1% by mass into an organic solvent (ethanol) and immersing the iron powder in an amount of 1,000 g into a 200 mL coating liquid held in a beaker. After leaving them in this state for 10 minutes, they were put in a 120° C. drying furnace to evaporate the ethanol. Thus, an iron powder coated with phosphate was obtained.

② Next, a die having a cylinder-shaped cavity (ϕ 17×100 mm) and made of cemented carbide was prepared. This forming mold was heated to 150° C. with a band heater in advance. Moreover, an inner peripheral surface of the die was subjected to a TiN coat treatment in advance so that the superficial roughness was 0.4Z.

And, onto the inner peripheral surface of the heated die, lithium stearate dispersed in an aqueous solution was applied uniformly with a spray gun at rate of 1 $cm^3$/sec. approximately (an applying step).

This aqueous solution is such that a surfactant and an antifoaming agent was added to water. As the surfactant, 6-grade polyoxyethylene nonyl phenyl ether (EO), 10-grade (EO) and boric acid ester-based emulbon "T-80" were used, and each of them was added in an amount of 1% by volume each with respect to the entire aqueous solution (100% by volume). Moreover, as the antifoaming agent, "FS antifoam 80" was used, and was added in an amount of 0.2% by volume with respect to the entire aqueous solution (100% by volume).

Moreover, as the lithium stearate, one exhibiting a melting point of about 225° C. and having an average particle diameter of 20 $\mu$m was used. The dispersion amount was 25 g with respect to 100 $cm^3$ of the aforementioned aqueous solution. And, this was further subjected to a finely-pulverizing treatment ("Teflon"-coated steel balls: 100 hours) by using a ball-mill type pulverizer, the resulting stock liquid was diluted by 20 times to be an aqueous solution whose final concentration was 1%, and was used in the aforementioned applying step.

③ Next, into the die in which the lithium stearate was applied to the inner surface and which was in a heated state, the aforementioned magnetic core powder provided with the phosphate film was filled (a filling step), magnetic core powder which was heated to 150° C., the temperature identical therewith.

④ Next, while holding the die at 150° C., the aforementioned magnetic core powder which had been subjected to the phosphate treatment was warm pressure formed with a variety of pressures within a range of from 392 to 1,960 MPa (i.e., a forming step).

(2) Comparative Example

As a raw material powder for a comparative material, a commercially available iron powder ("Somaloy500+ 0.5Kenolube" produced by Höganäs AB.) in which a lubricant was mixed in advance was prepared. And, the powder as it was procured was filled into the aforementioned die, and was pressure formed at room temperature. Of course, no lithium stearate aqueous solution was applied onto the inner surface of the die at all.

Note that the pressure forming was carried out while increasing the compacting pressure from 392 MPa successively in the same manner as the case of the example. However, since galling and the like occurred so that the die was damaged, the compacting pressure reached the limit at 1,000 MPa.

(3) Measurement and Assessment

Figure 2:
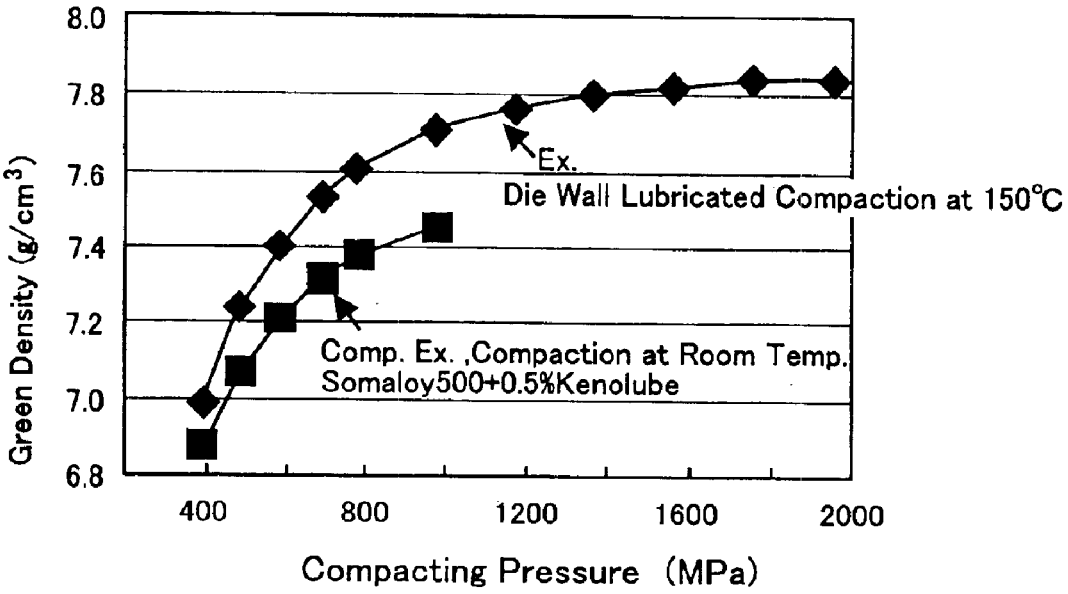
FIG. 2 is a graph for illustrating the relationships between compacting pressures and densities of obtained green compacts (densities of compacted bodies).

FIG. 1 illustrates the measurement results on the ejecting forces required when green compacts were taken out from the die in compacting the respective powders of the aforementioned example and comparative example. Moreover, FIG. 2 illustrates the measurement results on the density of the green compacts (the density of the compacted bodies) obtained in that instance. Note that the ejecting forces are values which were found by measuring the ejecting loads by means of a load cell and dividing the resulting ejecting loads by the lateral area of the green compacts. The densities of the formed body are values which were measured by an Archimedes method.

① First, as can be seen from FIG. 1, compared with the case where the internally lubricated Fe powder was pressure formed at room temperature as having done conventionally, the ejecting forces lowered remarkably when the present production process was used. In addition, the maximum value of the ejecting force was 11 MPa approximately at the highest. And, in the case where the production process according to the present was used, the maximum ejecting force was exhibited when the compacting pressure was 600 MPa, and thereafter the ejecting force decreased conversely as the compacting pressure increased. Moreover, even when the compacting pressure was increased to high pressures falling in a range of from 1,000 MPa to 2,000 MPa, the ejecting force maintained such a low value as about 5 MPa. This phenomenon precisely overturns the conventional common knowledge, and is a notable effect according to the present production process.

On the other hand, in the case of the comparative material compacted at room temperature, the ejecting force increased simply as the compacting pressure enlarged. And, when the compacting pressure was 800 MPa or more, galling occurred on the inner surface of the die so that it was difficult to eject the green compacts.

② Next, as can be seen from FIG. 2, when the present production process was used, the density of the obtained green compacts increased simply as the compacting pressure enlarged. Moreover, even by identical compacting pressures, the density of the obtained compacted body was larger in the green compacts according to the present invention than in the comparative material. Specifically, in the case of the green compacts according to the present invention, the density of the compacted body reached $7.4\times10^3$ kg/$m^3$, when the compacting pressure was 600 MPa, and the density was $7.8\times10^3$ kg/$m^3$ or more when the compacting pressure was 1,400 MPa or more. In addition, when the compacting pressure was further enlarged, the density of the compacted body approached $7.86\times10^3$ kg/$m^3$, the true density of pure iron, limitlessly.

On the other hand, in the case of the comparative material compacted at room temperature, since an admixed lubricant was included and the compacting pressure could not be enlarged to high pressures, the compacted body density of $7.5\times10^3$ kg/$m^3$ or more was not obtained.

From these facts, it become apparent that, when the present production process is used, the ejecting force is maintained low even when the compacting pressure is enlarged to high pressures considerably, and that no galling and the like occur on the inner surface of dies. And, although it depends on compacting pressures, it become apparent that it is also possible to obtain high-density green compacts.

Therefore, in accordance with the present production process, it is possible to produce high-density powder magnetic cores efficiently and at reduced cost while extending the longevity of dies.

Powder Magnetic Core (1) Example

By using the above-described present production process, two types of test pieces, ring-shaped ones (outside diameter: $\phi$ 39 mm×inside diameter $\phi$ 30 mm×thickness 5 mm) and plate-shaped ones (5 mm×10 mm×55 mm), were manufactured for every sample.

The above-described raw material powder ("ABC100.30" produced by Höganäs AB.) was herein classified to use. Specifically, (i) those classified as particle diameters exceeding 105 μm were used in Sample Nos. 1 through 11; (ii) those classified as particle diameters of 105 μm or less were used in Sample Nos. 12 through 28; and (iii) those classified as particle diameters of 53 μm or less were used in Sample Nos. 29 through 32.

Phosphate (insulation film) coating was carried out onto the respective raw material powders (a coating step). This coating step was carried out by mixing a phosphoric acid in a proportion of 1% by mass into an organic solvent (ethanol) and immersing the respective raw material powders in an amount of 1,000 g into a 200 mL coating liquid held in a beaker. After leaving them in this state for 10 minutes, they were put in a 120° C. drying furnace to evaporate the ethanol. Thus, respective raw material powders (Fe powders) coated the phosphate were obtained.

And, the cavity configuration of using dies was changed depending on the aforementioned shape of the respective test pieces, but the above-described present production process was followed fundamentally except for it, thereby producing the respective test pieces. Thus, test pieces comprising Sample Nos. 1 through 32 set forth in Tables 1 through 3 were obtained.

Here, in addition to the previous data (marked with * in a table) regarding test pieces of Sample Nos. 1 through 7, data regarding test pieces of Sample Nos. 8 through 32 were newly added by means of additional tests by the present inventors.

Note that, as described above, it is common in the respective samples that 2 types of the test pieces having different shapes existed for each of the samples. The ring-shaped test pieces were used for assessing the magnetic characteristics described later, and the plate-shaped test pieces were used for assessing the specific resistance and strength. Moreover, it is needles to say that no galling and the like occurred between the inner surface of the dies and the outer surface of the test pieces, powder magnetic cores, in all of the test pieces.

② The present inventors further carried out additional tests, and newly obtained data regarding test samples which were manufactured in the same manner as described above by using Sample Nos. 33 through 39 in which only the used raw material powders were changed. This is set forth in Table 4.

Sample Nos. 33 and 34 were such that a water-atomized powder produced by DAIDO STEEL Co., Ltd. (Fe-27% by mass Co and particle diameters of 150 μm or less) was used.

Sample Nos. 33 through 38 were such that a mixture powder was used in which 20% by volume of the water-atomized powder and 80% by volume of the above-described Fe powder ("ABC100.30" produced by Höganäs AB.: particle diameters of from 20 to 180 μm) were mixed uniformly with a ball mill-type rotary mixer for 30 minutes.

Moreover, in Sample No. 39, a water-atomized powder produced by DAIDO STEEL Co., Ltd. (Fe-1% by mass Si and particle diameters of 150 μm or less) was used.

Note that the phosphate film coating to the respective powders was carried out in the same manner as the above-described example.

③ In addition, regarding a part of the samples set forth in Tables 1 through 4, annealing (anneal) for removing stress was carried out (an annealing step). This step was carried out by cooling them after heating them in air at from 300 to 500° C. for 30 minutes.

(2) Comparative Example

Next, regarding 5 types of Sample Nos. C1 through C5 set forth in Table 5, 2 types of the above-described test pieces (ring-shaped test pieces and plate-shaped pieces) were also manufactured, respectively. The test pieces of Sample Nos. C1 through C4 were powder magnetic cores in which the raw material powders were compacted, and the test pieces of Sample Nos. C5 were magnetic cores which comprised an ingot material. Specifically, they were as hereinafter described.

① As the raw material powder for Sample No. C1, a commercially available powder ("Somaloy550+0.6LB1" produced by Höganäs AB.) for powder magnetic cores was prepared, powder which contained a lubricant. This was filled into the dies, and was warm compacted by 686 MPa at 150° C., thereby manufacturing 2 types of said test pieces.

② The test pieces of Sample No. C2 were such that a 275° C.×1 hour heat treatment (annealing: cooling after heating) was applied to the test pieces of Sample No. C1.

③ As the raw material powder for Sample No. C3, a commercially available powder ("Somaloy550+0.5Kenolube" produced by Höganäs AB.) for powder magnetic cores was prepared, powder which contained a lubricant. This was filled into the dies, and was warm compacted by 784 MPa at room temperature, thereby manufacturing 2 types of said test pieces.

④ The test pieces of Sample No. C4 were such that a 500° C.×30 minutes heat treatment (annealing: cooling after heating) was applied to the test pieces of Sample No. C3.

Note that, when manufacturing the respective test pieces of Sample Nos. C1 through C4, no higher fatty acid-based lubricant was applied to the inner surface of the dies at all. Moreover, since the compaction in this instance was carried out in such a range that no galling and the like occurred to the dies, contrarily to the above-described example, the compacting pressure could not be enlarged so much.

④ The test pieces of Sample No. C5 were magnetic cores made of a commercially available electromagnetic stainless steel (produced by AICHI STEEL Co., Ltd., "AUM-25," Fe-13Cr—Al—Si-based one) which has been used widely for actuators and the like.

(3) Measurements

Regarding the above-described respective test pieces, the electromagnetic characteristics, the specific resistance, the strength and the density were measured, and the results are set forth in Tables 1 through 5 altogether.

Here, among the magnetic characteristics, the static magnetic field characteristics were measured by a DC auto-recording magnetic flux meter (Maker: TOEI KOGYO Co., Ltd., Model Number: MODEL-TRF). The AC current magnetic field characteristics were measured by an AC B-H curve tracer (Maker: RIKEN DENSHI Co., Ltd., Model Number: ACBH-100K).

The AC magnetic field characteristics in tables are such that the high-frequency losses were measured when the powder magnetic cores were put in a magnetic field of 800 Hz and 1.0 T. Moreover, the magnetic flux densities in the static magnetic field specify the magnetic flux densities which were produced when the strength of the magnetic filed was varied in the order of 0.5, 1, 2, 5, 8 and 10 kA/m sequentially, and are recited in the respective tables as $B_{0.5k}$, $B_{1k}$, $B_{2k}$, $B_{5k}$, $B_{8k}$ and $B_{10k}$ respectively.

The saturation magnetization was measured by processing the compacted bodies into a 3 mm×3 mm×1 mm plate shape and with a VSM (TOEI KOGYO Co., Ltd., "VSM-35-15"). Note that, in tables, the specified values are such that the magnetization values (emu/g) produced in a 1.6 MA/m magnetic filed were converted into the T units with the densities.

The specific resistance was measured with a micro-ohmmeter (Maker: Hewlett-Packard Co., Ltd., Model Number: 34420A) by a four-probe method.

The strength is such that the 4-point bending strength was measured.

The density was measured by an Archimedes method.

(4) Assessment

① All of the test pieces of the example set forth in Tables 1 through 4 had a sufficiently high density, and showed better magnetic characteristics and electric characteristics than the test pieces of the comparative example did. Moreover, the mechanical strength was sufficiently high as well.

② When the AC magnetic field characteristics of the respective samples in Tables 1 through 3 are observed while taking the data obtained by the additional tests as well into consideration, the finer the particle diameter of the used raw material powder was, the more the eddy current loss tended to lower. On the contrarily, the coarser the particle diameter was, the more the hysteresis loss tended to lower. Therefore, it was newly confirmed this time that, when the particle diameter of using raw material powders is adjusted depending on the required characteristics of target appliances, it is possible to obtain powder magnetic cores with less loss.

③ When the powder magnetic cores to which the annealing was carried out after the compaction are compared with the powder magnetic cores to which the annealing was not carried out, the following can be understood.

When the annealing was carried out, the magnetic flux densities $B_{2k}$ and $B_{10k}$ as well as the saturation magnetization Ms were improved. On the other hand, when the annealing was not carried out, the specific resistance could be kept large compared with the case where the annealing was carried out, and accordingly it is possible to reduce the high-frequency loss. Moreover, when the annealing was carried out, the higher the temperature was, the more the magnetic characteristics were improved, but the specific resistance were lowered. Therefore, depending on the required characteristics of target appliances, whether the annealing is carried out or not, and the annealing temperature can be selected appropriately.

① It is understood from Table 4 that those using the Fe—Co alloy powder and those using the mixture powder of the pure iron powder and Fe—Co powder were such that the maximum 1.86 T was produced for $B_{10k}$ and the maximum 2.15 T was produced for the saturation magnetization. Namely, when Co was included, powder magnetic cores were obtained which had a higher magnetic flux density than pure iron did. Moreover, even when a high-hardness alloy such as an Fe—Si-based one was used, high-density compacts were obtained whose density $\geqq 7.4\times10^3$ kg/m$^3$. From these results, it is seen that, depending on the required characteristics of target appliances, it is possible to appropriately select and use raw material powders having proper compositions.

⑤ Note that all of the powder magnetic cores were such that the high-frequency loss was reduced sharply (to such an extent of about ⅓) compared with the test pieces comprising the ingot material of Sample No. C5.

Performance Test by Actual Device

The present inventors newly carried out the following additional test in order to confirm the effectiveness of the powder magnetic cores obtained as described above on an actual device.

Measurement

Figure 3:
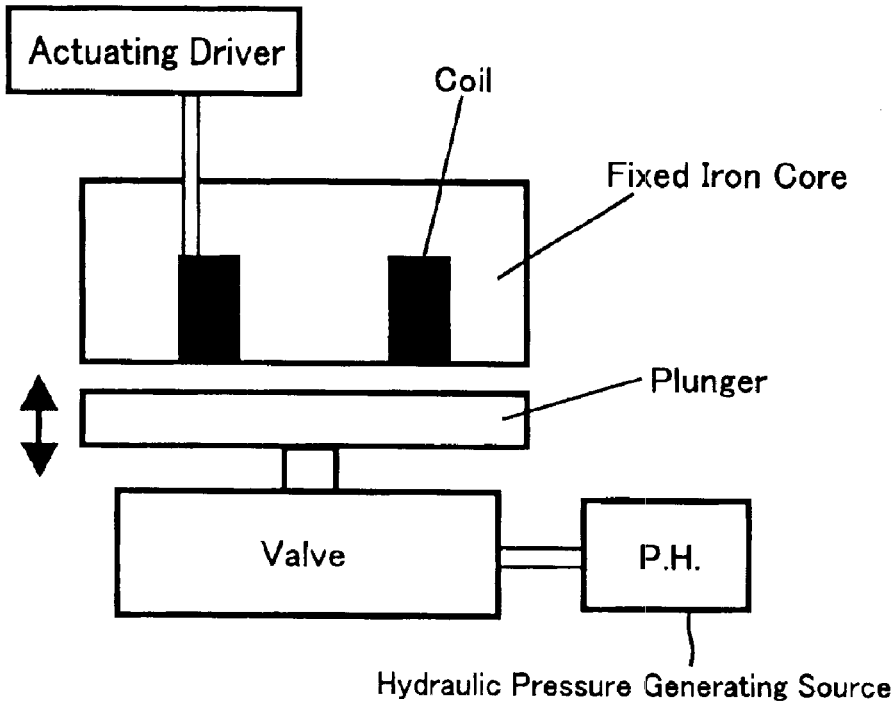
FIG. 3 is an outline diagram of a device for measuring and testing pulse control times, device which uses a solenoid valve.

① A hydraulically controlling solenoid valve in which a fixed iron core comprising aforementioned Sample No. 16, which was added this time, was used to measure the pulse control time, an index of response. The device used for this measurement mainly comprises, as illustrated in FIG. 3, a solenoid valve, an actuating driver for PWM controlling the solenoid valve, and a hydraulic pressure generating source for applying hydraulic pressures to the solenoid valve by way of a hydraulic circuit.

The solenoid valve used herein were a prototype which was prepared for this test. As can be seen from FIG. 3, the solenoid valve basically comprises a fixed iron core, a coil wound around a bobbin and accommodated in the fixed iron core, a plunger (made of JIS SUYB1 material) attracted and repelled in accordance with intermittent magnetic fields (alternating magnetic fields) which generate in and around the coil and fixed iron core, and a valve opening and closing an oil hole by the reciprocating movement of the solenoid valve.

Note that the fixed iron core was formed as a cylinder shape (ϕ 35×10 mm) whose cross-section was an inverted letter-"E" shape, had annular-shaped grooves (ϕ 27 mm×ϕ 17 mm×5 mm), and comprises a powder magnetic core which was formed integrally by the above-described present production process.

② As a comparative example, instead of the fixed iron core comprising said powder magnetic core of Sample No. 16, a fixed iron core which was newly prepared and comprised an ingot material of electromagnetic soft iron (a material equivalent to JIS SUYB1) was used to carry out the same measurement as the aforementioned example.

(2) Assessment

Figure 4:
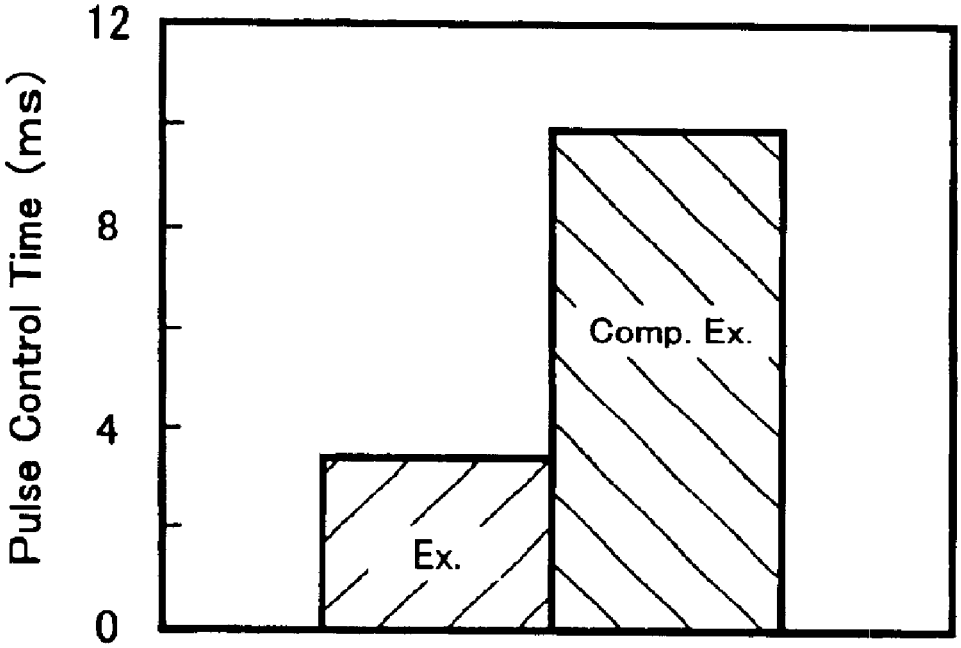
FIG. 4 is a bar graph for comparing the pulse control times between an example and a comparative example.

The thus obtained pulse control times of the example and comparative example are illustrate in FIG. 4 in a contrastive manner. It is apparent from FIG. 4 that, when the fixed iron core of the example was used, the pulse control time was lowered by ½ or less with respect to the comparative example, a conventional product. Namely, it is seen that the response of the solenoid valve was improved remarkably.

This results from the facts that the fixed iron core of the example had a high density and produced a high magnetic flux density so that an attraction force equivalent to that of the electromagnetic soft iron arose, and that the specific resistance was so high as 11 $\mu\Omega$m that the eddy current was more inhibited from generating than the one made of the electromagnetic soft iron and accordingly the iron loss was less.

As described above, in accordance with the present powder magnetic core, it has become apparent that it is possible to produce a large magnetic flux density while reducing the high-frequency loss. Moreover, when the present production process is used, it is possible to industrially mass-produce powder magnetic cores which are good in terms of the magnetic characteristics and electric characteristics efficiently and at reduced cost.

TABLE 1

(Sample Nos. 1 through 7: Original Samples, and Sample Nos. 8 through 39: Additional Samples)

| Sample No. | Forming Condition (150° C.) Pressure (MPa) | Annealing Temp. (° C.) | Annealing Time (Min.) | Static Magnetic Field Characteristic $B_{0.5k}$ | $B_{1k}$ | $B_{2k}$ | $B_{5k}$ (T) | $B_{8k}$ | $B_{10k}$ | Saturation Magnetization Ms | Coercive Force bHc (A/m) | AC Magnetic Field Characteristic (1.0 T/800 Hz) Total Loss Pc | Hysteresis Loss Ph (kW/m$^3$) | Eddy Current Loss Pe | Specific Resistance (ρ Ωm) | 4-point Bending Strength (MPa) | Density (×10$^3$ kg/m$^3$) |
|---|---|---|---|---|---|---|---|---|---|---|---|---|---|---|---|---|---|
| 1* | 784 | None | | 0.26 | 0.66 | 1.10 | 1.44 | 1.56 | 1.62 | 1.95 | 450 | 1070 | 940 | 130 | 15 | 55 | 7.49 |
| 2* | 980 | None | | 0.30 | 0.74 | 1.16 | 1.52 | 1.64 | 1.70 | 1.97 | 430 | 1140 | 900 | 240 | 10 | 87 | 7.63 |
| 3* | 980 | 500 | 30 | 0.52 | 1.00 | 1.31 | 1.54 | 1.64 | 1.70 | 1.97 | 250 | 2544 | 770 | 1747 | 1.5 | 138 | 7.63 |
| 4* | 1176 | None | | 0.30 | 0.78 | 1.26 | 1.59 | 1.70 | 1.75 | 2.00 | 400 | 1100 | 950 | 150 | 7 | 105 | 7.72 |
| 5* | ↑ | 300 | 30 | 0.41 | 0.78 | 1.28 | 1.59 | 1.70 | 1.75 | 2.00 | 370 | 1700 | 810 | 890 | 6 | 137 | 7.72 |
| 6* | ↑ | 400 | 30 | 0.60 | 1.00 | 1.36 | 1.60 | 1.70 | 1.75 | 2.00 | 320 | 2000 | 800 | 1200 | 4 | 145 | 7.72 |
| 7* | ↑ | 500 | 30 | 0.62 | 1.08 | 1.38 | 1.60 | 1.70 | 1.75 | 2.00 | 260 | 1880 | 630 | 1250 | 1.5 | 146 | 7.72 |
| 8 | 1372 | None | | 0.42 | 0.94 | 1.34 | 1.64 | 1.75 | 1.80 | 2.01 | 400 | 1410 | 960 | 450 | 7 | 113 | 7.80 |
| 9 | 1568 | 400 | 30 | 0.60 | 1.14 | 1.45 | 1.67 | 1.76 | 1.82 | 2.01 | 320 | 1940 | 740 | 1200 | 4 | 161 | 7.81 |
| 10 | 1764 | None | | 0.44 | 0.94 | 1.38 | 1.66 | 1.77 | 1.82 | 2.01 | 400 | 1390 | 940 | 450 | 7 | 117 | 7.82 |
| 11 | 1960 | 400 | 30 | 0.64 | 1.18 | 1.48 | 1.69 | 1.79 | 1.84 | 2.02 | 310 | 2090 | 740 | 1350 | 4 | 201 | 7.85 |

(Used Powder in Sample Nos. 1 through 11: Pure iron powder whose particle diameters exceeded 105 μm)

TABLE 2

| Sample No. | Forming Condition (150° C.) Pressure (MPa) | Annealing Temp. (° C.) | Annealing Time (Min.) | Static Magnetic Field Characteristic $B_{0.5k}$ | $B_{1k}$ | $B_{2k}$ | $B_{5k}$ (T) | $B_{8k}$ | $B_{10k}$ | Saturation Magnetization Ms | Coercive Force bHc (A/m) | AC Magnetic Field Characteristic (1.0 T/800 Hz) Total Loss Pc | Hysteresis Loss Ph (kW/m$^3$) | Eddy Current Loss Pe | Specific Resistance (ρ Ωm) | 4-point Bending Strength (MPa) | Density (×10$^3$ kg/m$^3$) |
|---|---|---|---|---|---|---|---|---|---|---|---|---|---|---|---|---|---|
| 12 | 784 | None | | 0.38 | 0.82 | 1.20 | 1.48 | 1.60 | 1.66 | 1.90 | 360 | 1130 | 920 | 210 | 15 | 105 | 7.61 |
| 13 | ↑ | 400 | 30 | 0.50 | 0.95 | 1.28 | 1.51 | 1.62 | 1.67 | 1.90 | 320 | 1670 | 780 | 890 | 5 | 166 | 7.61 |
| 14 | 980 | None | | 0.42 | 0.89 | 1.29 | 1.57 | 1.68 | 1.74 | 1.92 | 360 | 1080 | 860 | 220 | 13 | 142 | 7.71 |
| 15 | ↑ | 400 | 30 | 0.54 | 1.04 | 1.37 | 1.60 | 1.70 | 1.76 | 1.92 | 310 | 1700 | 740 | 960 | 4 | 187 | 7.71 |
| 16 | 1176 | None | | 0.44 | 0.94 | 1.34 | 1.62 | 1.74 | 1.78 | 1.94 | 360 | 1200 | 880 | 320 | 11 | 147 | 7.77 |
| 17 | ↑ | 200 | 30 | 0.50 | 0.98 | 1.35 | 1.60 | 1.71 | 1.77 | 1.94 | 350 | 1050 | 800 | 500 | 9 | 157 | 7.77 |
| 18 | ↑ | 400 | 30 | 0.60 | 1.09 | 1.41 | 1.64 | 1.74 | 1.80 | 1.94 | 300 | 2000 | 700 | 1300 | 4 | 199 | 7.77 |
| 19 | ↑ | 500 | 30 | 0.66 | 1.16 | 1.44 | 1.64 | 1.74 | 1.80 | 1.94 | 270 | 2660 | 640 | 2020 | 2 | 210 | 7.77 |
| 20 | 1372 | None | | 0.42 | 0.92 | 1.34 | 1.63 | 1.73 | 1.79 | 1.95 | 370 | 1100 | 770 | 330 | 10 | 150 | 7.80 |
| 21 | ↑ | 400 | 30 | 0.57 | 1.04 | 1.42 | 1.66 | 1.76 | 1.81 | 1.95 | 260 | 1860 | 650 | 1210 | 4 | 214 | 7.80 |
| 22 | 1568 | None | | 0.50 | 0.98 | 1.37 | 1.64 | 1.75 | 1.80 | 1.95 | 350 | 1200 | 760 | 440 | 8 | 159 | 7.82 |
| 23 | ↑ | 400 | 30 | 0.58 | 1.09 | 1.43 | 1.67 | 1.77 | 1.81 | 1.95 | 300 | 2000 | 640 | 1360 | 3 | 207 | 7.82 |
| 24 | ↑ | 500 | 30 | 0.72 | 1.16 | 1.44 | 1.65 | 1.75 | 1.80 | 1.95 | 260 | 2030 | 510 | 1520 | 2 | 213 | 7.82 |
| 25 | 1764 | None | | 0.56 | 1.02 | 1.40 | 1.67 | 1.78 | 1.84 | 1.96 | 360 | 1000 | 770 | 230 | 8 | 160 | 7.84 |
| 26 | ↑ | 400 | 30 | 0.62 | 1.09 | 1.44 | 1.68 | 1.78 | 1.84 | 1.96 | 320 | 1460 | 730 | 730 | 3 | 208 | 7.84 |
| 27 | 1960 | None | | 0.56 | 1.03 | 1.41 | 1.68 | 1.78 | 1.84 | 1.96 | 360 | 1300 | 790 | 510 | 8 | 163 | 7.84 |
| 28 | ↑ | 400 | 30 | 0.64 | 1.10 | 1.45 | 1.69 | 1.79 | 1.84 | 1.96 | 320 | 1780 | 710 | 1070 | 3 | 209 | 7.84 |

(Used Powder in Sample Nos. 12 through 28: Pure iron powder whose particle diameters exceeded 105 μm)

TABLE 3

| Sample No. | Forming Condition (150° C.) Pressure (MPa) | Annealing Temp. (° C.) | Annealing Time (Min.) | Static Magnetic Field Characteristic $B_{0.5k}$ | $B_{1k}$ | $B_{2k}$ | $B_{5k}$ (T) | $B_{8k}$ | $B_{10k}$ | Saturation Magnetization Ms | Coercive Force bHc (A/m) | AC Magnetic Field Characteristic (1.0 T/800 Hz) Total Loss Pc | Hysteresis Loss Ph (kW/m$^3$) | Eddy Current Loss Pe | Specific Resistance (ρ Ωm) | 4-point Bending Strength (MPa) | Density (×10$^3$ kg/m$^3$) |
|---|---|---|---|---|---|---|---|---|---|---|---|---|---|---|---|---|---|
| 29 | 980 | None | | 0.26 | 0.68 | 1.16 | 1.52 | 1.66 | 1.72 | 1.90 | 410 | 960 | 910 | 50 | 11 | 80 | 7.71 |
| 30 | ↑ | 400 | 30 | 0.34 | 0.79 | 1.23 | 1.54 | 1.66 | 1.72 | 1.90 | 360 | 980 | 820 | 160 | 4 | 105 | 7.71 |
| 31 | 1176 | None | | 0.30 | 0.71 | 1.20 | 1.58 | 1.70 | 1.76 | 1.92 | 400 | 780 | 730 | 50 | 11 | 91 | 7.77 |
| 32 | ↑ | 400 | 30 | 0.34 | 0.82 | 1.27 | 1.58 | 1.70 | 1.76 | 1.92 | 350 | 1100 | 810 | 200 | 4 | 112 | 7.77 |

(Used Powder in Sample Nos. 29 through 32: Pure iron powder whose particle diameters were 53 μm or less)

TABLE 4

| Sample No. | Forming Condition (150° C.) Pressure (MPa) | Annealing Temp. (° C.) | Annealing Time (Min.) | Static Magnetic Field Characteristic $B_{0.5k}$ | $B_{1k}$ | $B_{2k}$ | $B_{5k}$ (T) | $B_{8k}$ | $B_{10k}$ | Saturation Magnetization Ms | Coercive Force bHc (A/m) | AC Magnetic Field Characteristic (1.0 T/800 Hz) Total Loss Pc | Hysteresis Loss Ph (kW/m$^3$) | Eddy Current Loss Pe | Specific Resistance (ρ Ωm) | 4-point Bending Strength (MPa) | Density (×10$^3$ kg/m$^3$) |
|---|---|---|---|---|---|---|---|---|---|---|---|---|---|---|---|---|---|
| 33 | 1960 | None | | 0.10 | 0.65 | 1.11 | 1.42 | 1.70 | 1.83 | 2.15 | 1300 | 3000 | 2500 | 500 | 7 | 90 | 7.91 |
| 34 | ↑ | 400 | 30 | 0.11 | 0.70 | 1.15 | 1.46 | 1.74 | 1.86 | 2.15 | 1300 | 3500 | 2400 | 1100 | 3 | 105 | 7.91 |
| 35 | 1764 | None | | 0.38 | 0.80 | 1.22 | 1.58 | 1.74 | 1.80 | 1.95 | 410 | 1700 | 900 | 800 | 3 | 150 | 7.84 |
| 36 | ↑ | 400 | 30 | 0.44 | 0.88 | 1.26 | 1.60 | 1.75 | 1.82 | 1.95 | 380 | 2000 | 800 | 1200 | 2 | 180 | 7.84 |
| 37 | 1960 | None | | 0.39 | 0.80 | 1.20 | 1.58 | 1.74 | 1.81 | 1.96 | 450 | 1800 | 950 | 850 | 3 | 153 | 7.86 |
| 38 | ↑ | 400 | 30 | 0.44 | 0.88 | 1.28 | 1.61 | 1.76 | 1.83 | 1.96 | 370 | 2050 | 810 | 1240 | 2 | 186 | 7.86 |
| 39 | 1960 | 400 | 30 | 0.30 | 0.68 | 1.10 | 1.51 | 1.65 | 1.71 | 1.90 | 350 | 1260 | 750 | 510 | 10 | 80 | 7.74 |

(Used Powder in Sample Nos. 33 and 34: Fe-27% Co water-atomized powder)
(Used Powder in Sample Nos. 35 through 38: Fe-27% Co water-atomized powder & Pure iron powder)
(Used Powder in Sample No. 39: Fe-1% Si water-atomized powder)

TABLE 5

| Sample No. | Forming Condition (150° C.) Presure (MPa) | Forming Condition (150° C.) Temp. (° C.) | Annealing Temp. (° C.) | Annealing Time (Min.) | Static Magnetic Field Characteristic $B_{0.5k}$ | $B_{1k}$ | $B_{2k}$ | $B_{5k}$ (T) | $B_{8k}$ | $B_{10k}$ | Saturation Magnetization Ms | Coercive Force bHc (A/m) | AC Magnetic Field Characteristic (1.0 T/800 Hz) Total Loss Pc | Hysteresis Loss Ph (kW/m$^3$) | Eddy Current Loss Pe | Specific Resistance (ρ Ωm) | 4-point Bending Strength (MPa) | Density (×10$^3$ kg/m$^3$) |
|---|---|---|---|---|---|---|---|---|---|---|---|---|---|---|---|---|---|---|
| C1 | 686 | 150 | None | | 0.12 | 0.34 | 0.70 | 1.18 | 1.36 | 1.44 | 1.85 | 450 | 1200 | 910 | 290 | 1080 | 25 | 7.31 |
| C2 | ↑ | 150 | 275 | 60 | 0.10 | 0.43 | 0.84 | 1.26 | 1.42 | 1.48 | 1.85 | 350 | 1010 | 900 | 110 | 2000 | 90 | ↑ |
| C3 | 784 | Room Temp. | None | | 0.24 | 0.64 | 1.02 | 1.36 | 1.47 | 1.54 | 1.87 | 300 | 1500 | 920 | 580 | 600 | 14 | 7.38 |
| C4 | ↑ | Room Temp. | 500 | 30 | 0.26 | 0.64 | 1.02 | 1.36 | 1.48 | 1.54 | 1.87 | 300 | 1800 | 1030 | 770 | 48 | 35 | ↑ |
| C5 | Ingot Material | | — | | 1.08 | 1.18 | 1.26 | 1.40 | 1.48 | 1.51 | 1.60 | 35 | 4940 | 130 | 4810 | 1.0 | — | 7.50 |

What is claimed is:

1. A powder magnetic core obtained by compacting an iron-based magnetic powder covered with an insulation film, wherein:

a saturation magnetization Ms is Ms≧1.9 T in a 1.6 MA/m magnetic field;

a specific resistance ρ is ρ≧1.5 μΩm;

a magnetic flux density $B_{2k}$ is $B_{2k}$≧1.1 T in a 2 kA/m magnetic field; and a magnetic flux density $B_{10k}$ is $B_{10k}$≧1.6 T in a 10 kA/m magnetic field.

2. The powder magnetic core set forth in claim 1, wherein a density d is d≧7.4×10$^3$ kg/m$^3$.

3. The powder magnetic core set forth in claim 1, wherein said specific resistance ρ is ρ≧7 μΩm.

4. The powder magnetic core set forth in claim 3, wherein said specific resistance ρ is ρ≧10 μΩm.

5. The powder magnetic core set forth in claim 1, wherein said magnetic flux density $B_{2k}$ is $B_{2k}$≧1.3 T.

6. The powder magnetic core set forth in claim 1, wherein said magnetic flux density $B_{10k}$ is $B_{10k}$≧1.7 T.

7. The powder magnetic core set forth in claim 1 whose 4-point bending strength σ is σ≧50 MPa.

8. The powder magnetic core set forth in claim 1, wherein said iron-based magnetic powder is an iron powder composed of pure iron with a purity of 99.8% or more.

9. The powder magnetic core set forth in claim 1, where said iron-based magnetic powder is an iron alloy powder including cobalt (Co) in an amount of 30% by mass or less.

10. The powder magnetic core set forth in claim 1, where said iron-based magnetic powder is an iron alloy powder including silicon (Si) in an amount of 2% by mass or less.

11. The powder magnetic core set forth in claim 1, wherein said iron-based magnetic powder is such that particle diameters fall in a range of from 20 to 300 μm.

12. The powder magnetic core set forth in claim 1, wherein said insulation film is a phosphate coating or an oxidized coating.

13. A process for producing a powder magnetic core comprising:

a coating step of coating an insulation film on a surface of an iron-based magnetic powder;

an applying step of applying a higher fatty acid-based lubricant to an inner surface of a die;

a filling step of filling the iron-based magnetic powder with the insulation film coated into the die with the higher fatty acid-based lubricant applied; and a forming step of warm pressure compacting the iron-based magnetic powder filled in the die.

14. The process for producing a powder magnetic core set forth in claim 13, wherein said coating step is a step in which a phosphoric acid is contacted with the iron-based magnetic powder to form a phosphate film on a surface of the iron-based magnetic powder.

15. The process for producing a powder magnetic core set forth in claim 13, wherein said applying step is a step in the higher fatty acid-based lubricant dispersed in water or an aqueous solution is sprayed into said die which is heated.

16. The process for producing a powder magnetic core set forth in claim 13, wherein said filling step is a step in which said iron-based magnetic powder which is heated is filled into said die which is heated.

17. The process for producing a powder magnetic core set forth in claim 13, wherein said forming step is a step in which a compacting temperature is from 100 to 220° C.

18. The process for producing a powder magnetic core set forth in claim 13, wherein said forming step is a step in which a compacting pressure is 700 MPa or more.

19. The process for producing a powder magnetic core set forth in claim 13, wherein said higher fatty acid-based lubricant is a metallic salt of higher fatty acids.

20. The process for producing a powder magnetic core set forth in claim 19, wherein said higher fatty acid-based lubricant is one or more members selected from the group consisting of lithium stearate, calcium stearate and zinc stearate.

21. The process for producing a powder magnetic core set forth in claim 13, wherein said higher fatty acid-based lubricant is such that a maximum particle diameter is less than 30 μm.

22. The process for producing a powder magnetic core set forth in claim 13, wherein an annealing step is further carried out in which a green compact obtained after said forming step is heated and is thereafter cooled gradually.

23. The process for producing a powder magnetic core set forth in claim 22, wherein said annealing step comprises a heating step in which a heating temperature is from 300 to 600° C. and a heating time is from 1 to 30 minutes.

24. A process for producing a powder magnetic core comprising:

a coating step of coating an insulation film on a surface of an iron-based magnetic powder;

an applying step of applying a higher fatty acid-based lubricant to an inner surface of a die;

a filling step of filling the iron-based magnetic powder with the insulation film coated into the die with the higher fatty acid-based lubricant applied; and a forming step of warm compacting the iron-based magnetic powder filled in the die;

whereby a powder magnetic core obtained is that:

the saturation magnetization Ms is Ms≧1.9 T in a 1.6 MA/m magnetic field;

the specific resistance ρ is ρ≧1.5 μΩm;

the magnetic flux density $B_{2k}$ is $B_{2k}$≧1.1 T in a 2 kA/m magnetic field; and the magnetic flux density $B_{10k}$ is $B_{10k}$≧1.6 T in a 10 kA/m magnetic field.

25. A powder magnetic core obtained by:

a coating step in which an insulation film containing Fe is coated on a surface of an iron-based magnetic powder;

an applying step of applying a higher fatty acid-based lubricant to an inner surface of a die;

a filling step of filling the iron-based magnetic powder with the insulation film coated into the die with the higher fatty acid-based lubricant applied; and a forming step of warm compaction of the iron-based magnetic powder filled in the die so that a metallic soap film is formed by a reaction between Fe in the insulation film and the higher fatty acid-based lubricant, wherein:

a saturation magnetization Ms is Ms≧1.9 T in a 1.6 MA/m magnetic field;

a specific resistance ρ is ρ≧1.5 μΩm;

a magnetic flux density $B_{2k}$ is $B_{2k}$≧1.1 T in a 2 kA/m magnetic field; and a magnetic flux density $B_{10k}$ is $B_{10k}$≧1.6 T in a 10 kA/m magnetic field.

26. A process for producing a powder magnetic core comprising:

a coating step in which an insulation film containing Fe is coated on a surface of an iron-based magnetic powder;

an applying step of applying a higher fatty acid-based lubricant to an inner surface of a die;

a filling step of filling the iron-based magnetic powder with the insulation film coated into the die with the higher fatty acid-based lubricant applied; and a forming step of warm compaction of the iron-based magnetic powder filled in the die so that a metallic soap film is formed by a reaction between Fe in the insulation film and the higher fatty acid-based lubricant.

* * * * *